US010781991B1

(12) United States Patent
Shih

(10) Patent No.: US 10,781,991 B1
(45) Date of Patent: Sep. 22, 2020

(54) PROJECTION HEADLIGHT

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 16/553,551

(22) Filed: Aug. 28, 2019

(51) Int. Cl.

| | |
|---|---|
| ***F21S 41/365*** | (2018.01) |
| ***F21S 41/33*** | (2018.01) |
| ***F21S 41/37*** | (2018.01) |
| ***F21V 29/75*** | (2015.01) |
| ***F21S 41/25*** | (2018.01) |
| ***F21S 41/43*** | (2018.01) |
| ***F21S 41/50*** | (2018.01) |

(52) U.S. Cl.
CPC ..... *F21S 41/365* (2018.01); *F21S 41/336* (2018.01); *F21S 41/37* (2018.01); *F21V 29/75* (2015.01); *F21S 41/25* (2018.01); *F21S 41/43* (2018.01); *F21S 41/50* (2018.01)

(58) Field of Classification Search
CPC ..... F21S 41/365; F21S 41/334–337
See application file for complete search history.

(56) References Cited

U.S. PATENT DOCUMENTS

| | | | | | |
|---|---|---|---|---|---|
| 1,469,690 | A * | 10/1923 | Smith | F21S 41/321 | 362/211 |
| 1,645,721 | A * | 10/1927 | Pfeil | F21S 41/365 | 362/277 |
| 1,981,328 | A * | 11/1934 | Rivier | F21S 41/162 | 362/298 |
| 5,967,647 | A * | 10/1999 | Eichler | F21S 41/28 | 362/304 |
| 2005/0088758 | A1* | 4/2005 | Minano | F21S 41/143 | 359/726 |
| 2006/0007544 | A1* | 1/2006 | Suzuki | F21V 9/04 | 359/533 |
| 2006/0120094 | A1* | 6/2006 | Tsukamoto | F21S 41/143 | 362/518 |
| 2007/0268717 | A1* | 11/2007 | Iwasaki | F21V 29/763 | 362/539 |

* cited by examiner

*Primary Examiner* — Alexander K Garlen
(74) *Attorney, Agent, or Firm* — Burris Law, PLLC

(57) ABSTRACT

A projection headlight includes a reflecting mirror, a light shield, a reflector, a lens and a light emitting unit. The reflecting mirror includes a first reflective surface unit. The light shield is disposed in the reflecting mirror and includes a second reflective surface unit facing rearwardly. The reflector is disposed behind the light shield and includes a third reflective surface unit facing forwardly. The light emitting unit is disposed behind the light shield, and emits a light beam reflected by the first reflective surface unit toward the second reflective surface unit, and then reflected by the second reflective surface unit toward the third reflective surface unit to be projected forwardly through the lens.

7 Claims, 8 Drawing Sheets

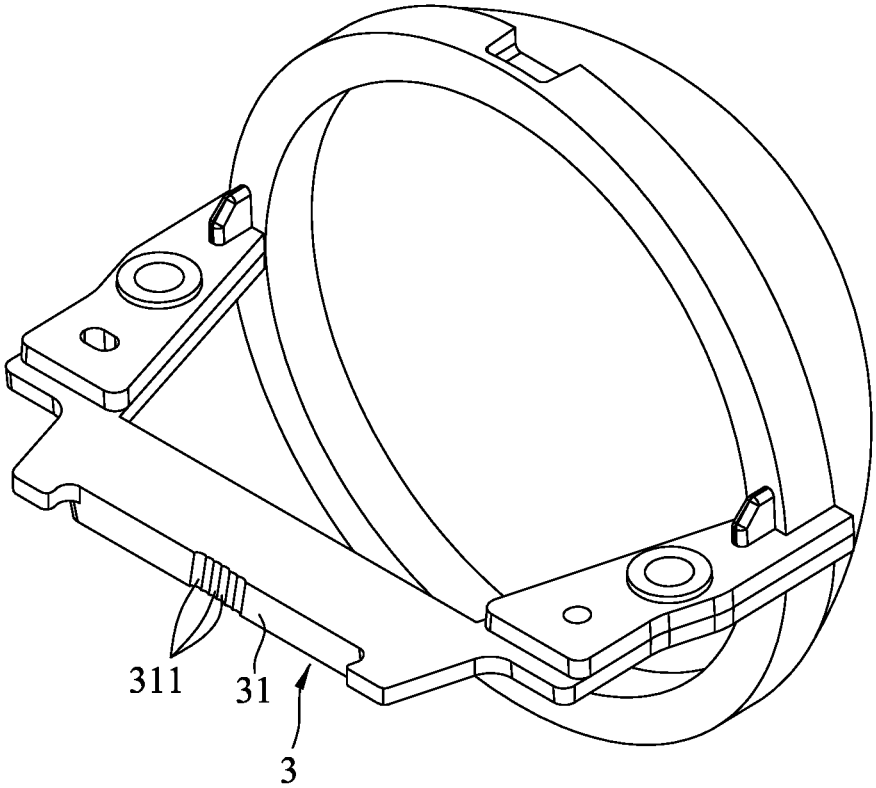
FIG.6
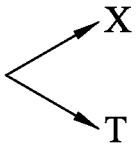

PROJECTION HEADLIGHT

FIELD

The disclosure relates to a headlight, more particularly to a projection headlight.

BACKGROUND

An ellipsoidal reflector headlamp usually includes at least one light source, e.g. a light emitting diode (LED), a reflective mirror, a light shield and a lens. Generally speaking, a region above a cut-off line of the reflector headlamp is referred to as a dark zone. In order to comply with regulations, the illuminance at the dark zone should be greater than a threshold illuminance to avoid dangerous. For example, when the illuminance at the dark zone is not sufficient for a user to find objects on the road, accidents may thus occur.

The reflective mirror and the light shield are usually provided to reflect light beams emitted from the light source to project light through the lens for light compensation at the dark region. The light shield can be categorized into a movable light shield that is electrically controlled to move and a stationary light shield that is mounted fixedly. A stationary light shield is designed to have a specific structure to reflect light and to project light patterns such as high beam and low beam as required. The reflector headlamp is usually mounted in a lamp housing to constitute a conventional headlamp module and then the conventional headlamp module is equipped on a vehicle. For the purpose of versatile and aesthetic appearance of the conventional headlamp module, a housing wall of the lamp housing is usually designed to have many curved structures. However, light beams are refracted by the curved housing wall and the light patterns thus formed are adversely affected. For example, sufficient illuminance at the dark zone cannot be achieved.

SUMMARY

Therefore, an object of the disclosure is to provide a projection headlamp capable of alleviating at least one of the drawbacks of the prior art.

According to one aspect of the disclosure, a projection headlight is provided. The projection headlight includes a reflecting mirror, a light shield, a reflector, a lens and a light emitting unit. The reflecting mirror has amounting space that is defined by a first reflective surface unit. The light shield is disposed in the mounting space and includes a second reflective surface unit facing rearwardly. The reflector is disposed in the mounting space, is disposed behind the light shield and includes a third reflective surface unit facing toward the second reflective surface unit. The lens is disposed in front of the reflecting mirror and the light shield. The light emitting unit is disposed in the mounting space, is disposed behind the light shield, and emits a light beam that is reflected by the first reflective surface unit toward the second reflective surface unit, and that is then reflected by the second reflective surface unit toward the third reflective surface unit to be projected forwardly through the lens.

BRIEF DESCRIPTION OF THE DRAWINGS

Other features and advantages of the disclosure will become apparent in the following detailed description of the embodiments with reference to the accompanying drawings, of which:

FIG. 6 is a perspective rear view of a modification of a light shield of the projection headlight the first embodiment;

DETAILED DESCRIPTION

Figure 1:
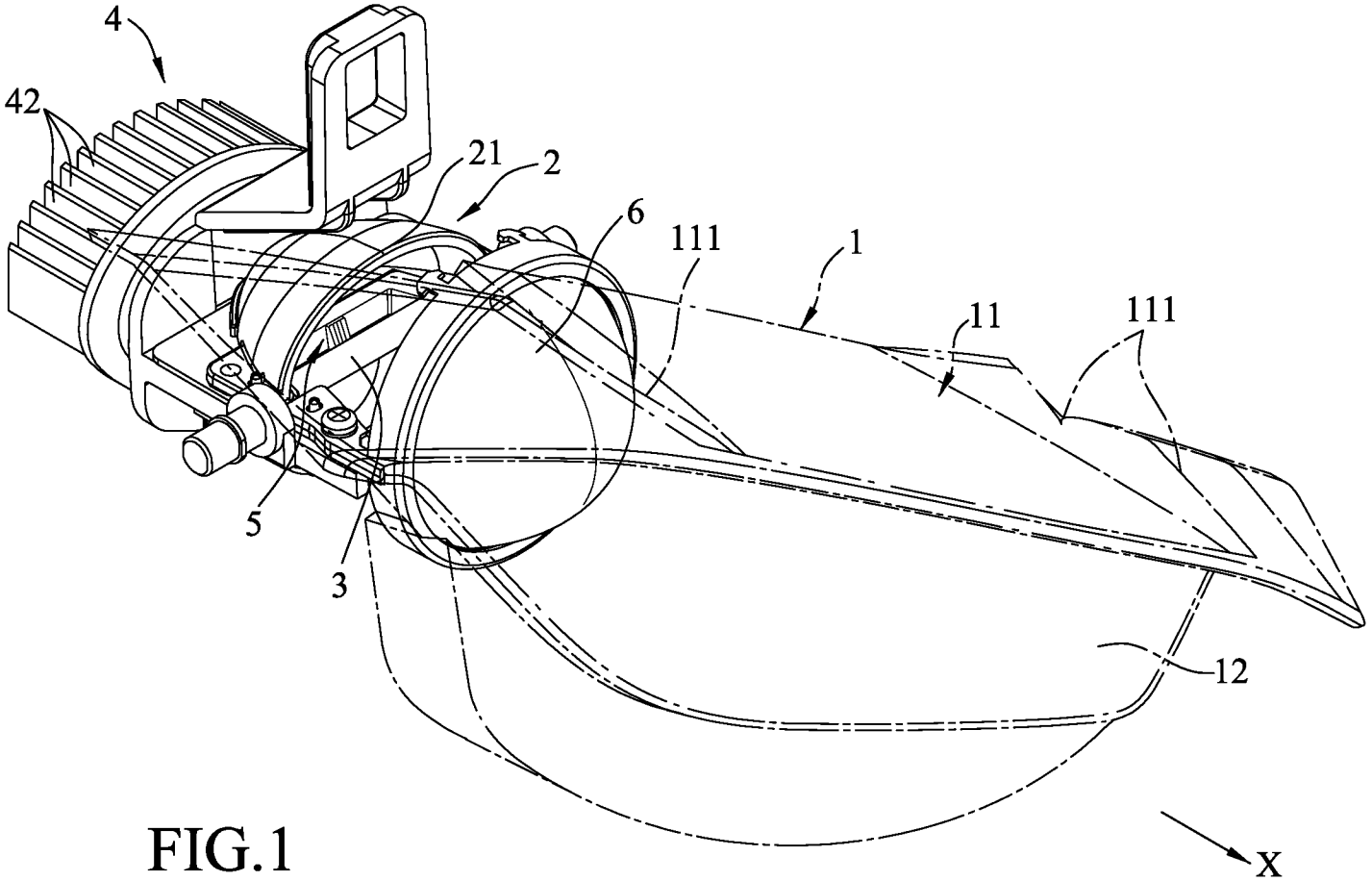
FIG. 1 is a perspective view of a projection headlight according to a first embodiment of the present disclosure and a lamp housing for mounting the headlight thereon.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
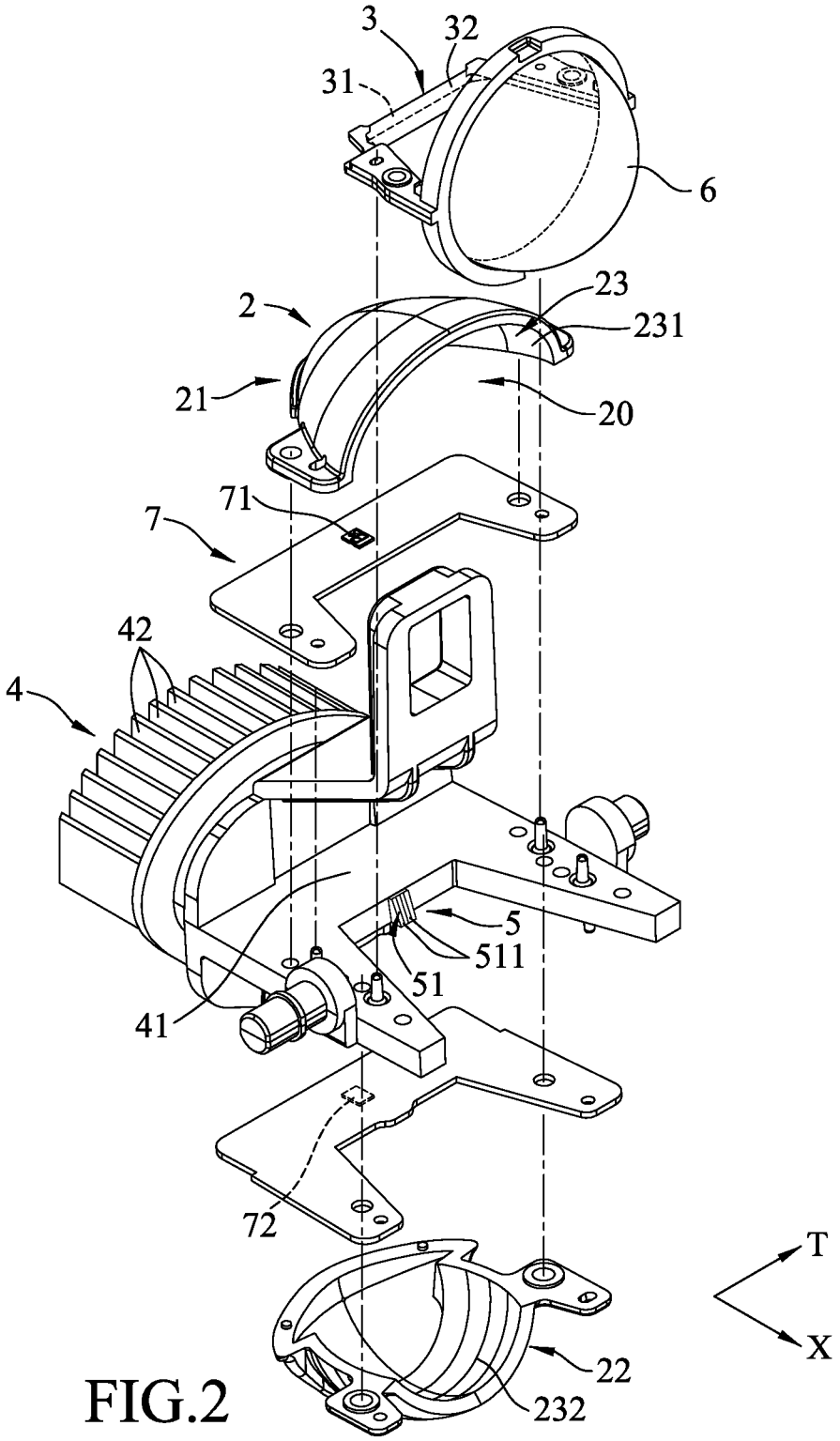
FIG. 2 is an exploded perspective view of the projection headlight of the first embodiment.
Figure 3:
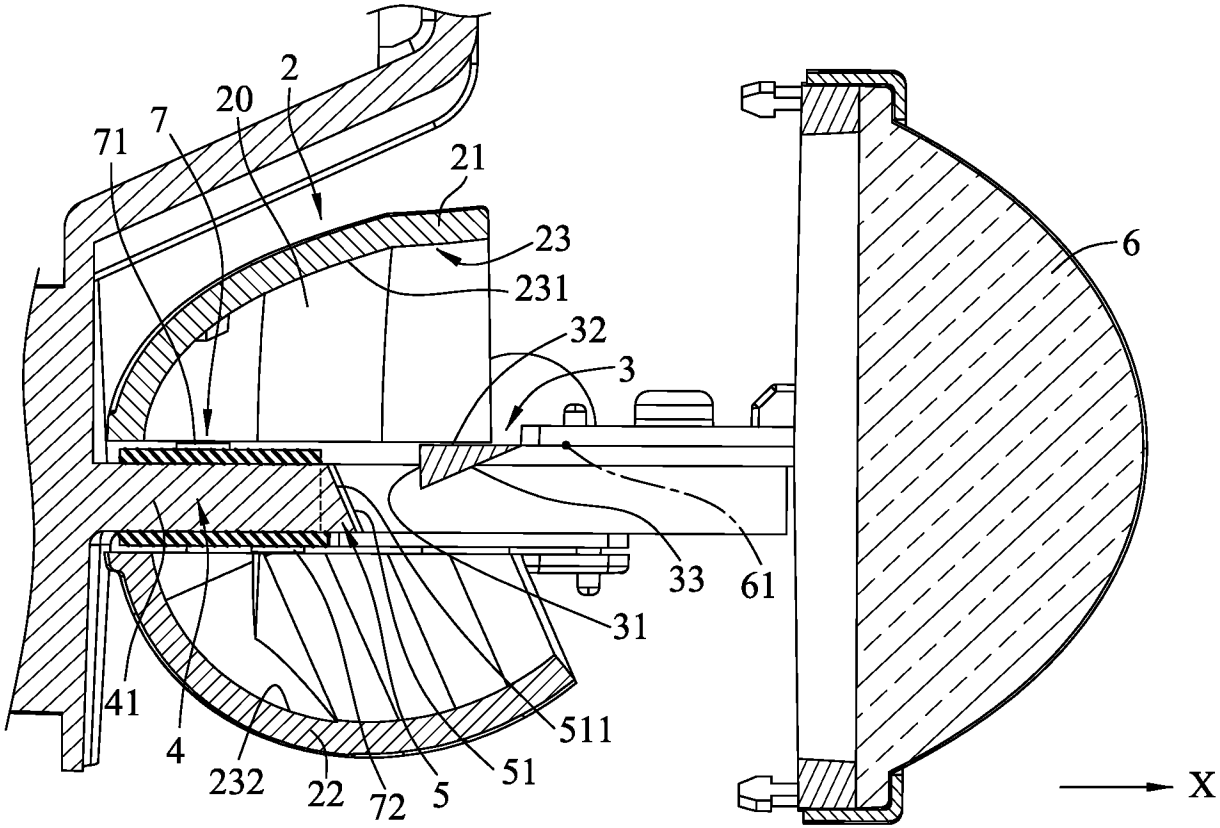
FIG. 3 is a fragmentary sectional view of the projection headlight of the first embodiment.

Referring to FIGS. 1-3, a projection headlight according to a first embodiment of the present disclosure is mounted in a lamp housing 1. The lamp housing 1 includes a housing wall 11 and a light transmissive wall 12 mounted on the housing wall 11 transmitting light beams from the projection headlight to project therethrough forwardly. The housing wall 11 includes a plurality of bent portions 111 making the lamp housing 1 to have a certain structural appearance. The projection headlight includes a reflecting mirror 2, a light shield 3, a heat dissipating unit 4, a reflector 5, a lens 6, and a light emitting unit 7.

The reflecting mirror 2 includes an upper reflecting portion 21, a lower reflecting portion 22, and a first reflective surface unit 23. The lower reflecting portion 22 is disposed below and cooperates with the upper reflecting portion 21 to define amounting space 20. The first reflective surface unit 23 includes an upper reflective surface 231 formed on the upper reflecting portion 21 and a lower reflective surface 232 formed on the lower reflecting portion 22. The upper reflective surface 231 and the lower reflective surface 232 are elliptic reflective surfaces in this embodiment.

The light shield 3 is disposed in the mounting space 20, has a thickness gradually decreased in a front-rear direction (X) in which the lens 6 is spaced apart from the reflecting mirror 2 and includes a second reflective surface unit 31, a top reflecting surface 32 and a bottom reflecting surface 33. The light shield 3 and the lens 6 may be integrated as a module but the present disclosure is not limited to this example.

The heat dissipating unit 4 includes a base board 41 and a plurality of heat dissipating fins 42. The base board 41 extends into the mounting space 20, is disposed between the upper reflecting portion 21 and the lower reflecting portion 22 and is connected thermally to the reflector 5. The heat dissipating fins 42 are integrally connected to the base board 41 and extend rearwardly from the base board 41.

The reflector 5 is disposed in the mounting space 20, is disposed behind the light shield 3 and includes a third reflective surface unit 51 facing forwardly toward the second reflective surface unit 31. The third reflective surface unit 51 is formed with a plurality of light distributing structures 511 arranged side-by-side in a transverse direction (T) transverse to the front-rear direction (X) and configured to distribute light emitted from the light emitting unit 7 in the transverse direction. In this embodiment, each of the light distributing structures 511 is a forward-facing curved surface that is rearwardly concave. By virtue of the light distributing structures 511, light shape of the projection headlight can be adjusted and distributed evenly to increase range of illumination of in the transverse direction (T).

In this embodiment, the reflector 5 is connected thermally to a front end of the base board 41 of the heat dissipating unit 4 and cooperates with the heat dissipating unit 4 to form a single element. Specifically, the third reflective surface unit 51 of the reflector 5 is formed on the front end of the base board 41 by vacuum coating so as to thermally connect the reflector 5 to the heat dissipating unit 4. As such, an assembly of the reflector 5 and the heat dissipating unit 4 provides reflecting function while performing heat dissipating.

The lens 6 is disposed in front of the reflecting mirror 2 and the light shield 3 in the front-rear direction (X). In this embodiment, the lens 6 is a convex lens.

The light emitting unit 7 is disposed in the mounting space 20, is disposed behind the light shield 3 in the front-rear direction (X) and includes a first light emitting element 71 and a second light emitting element 72. The first light emitting element 71 faces the upper reflecting portion 21, while the second light emitting element 72 faces the lower reflecting portion 22.

Figure 4:
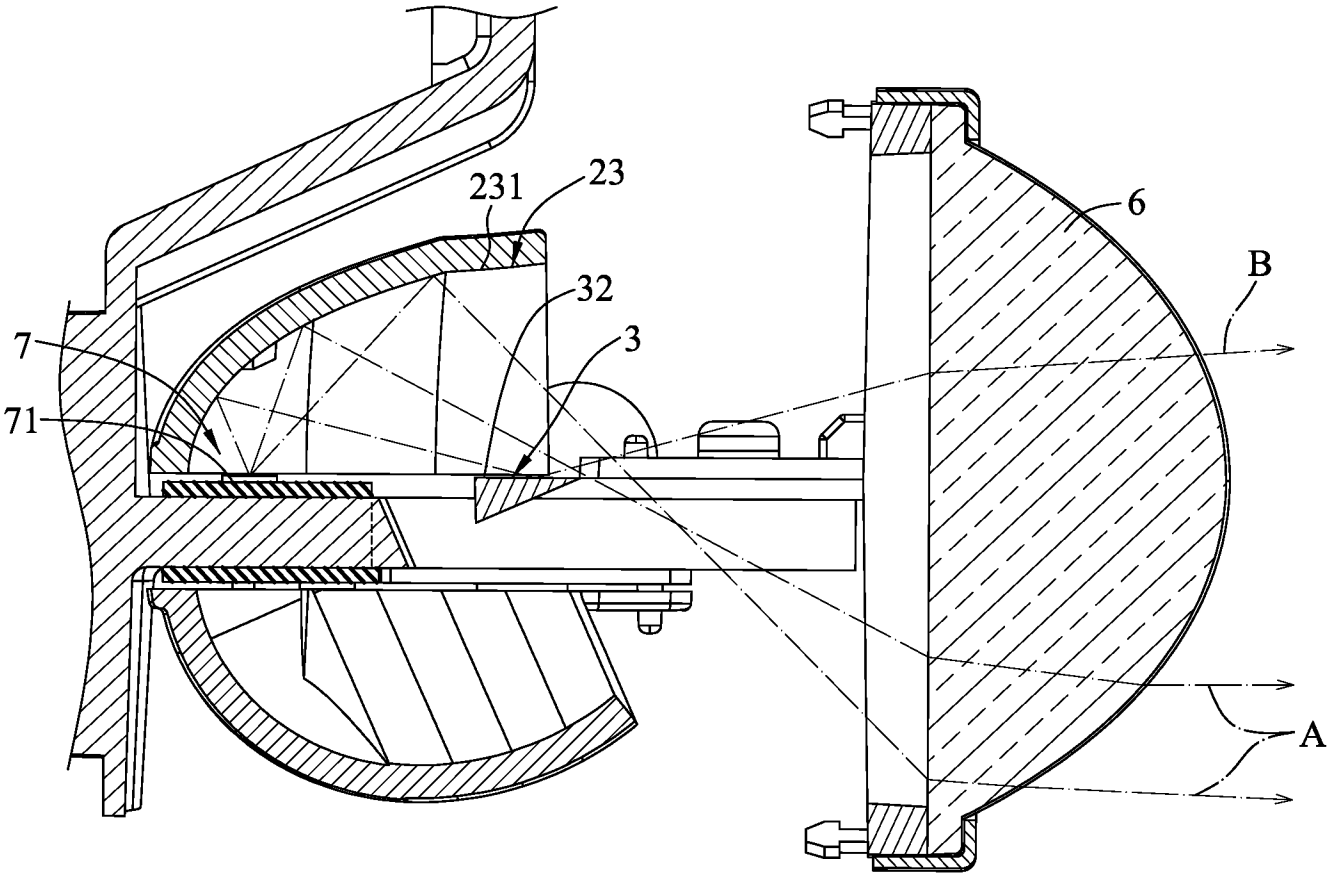
FIG. 4 is a fragmentary sectional view similar to FIG. 3, illustrating paths of light beams being emitted from a first light emitting element of the projection headlight and being reflected to form a low beam pattern.

Further referring to FIG. 4, the first light emitting element 71 emits a plurality of light beams and paths of the light beams are indicated by dash-dotted lines (A) and (B). The light beams indicated by the dash-dotted lines (A) are reflected by the upper reflective surface 231 of the first reflective surface unit 23 to propagate forwardly and downwardly and then are projected forwardly through the lens 6. The light beam indicated by the dash-dotted line (B) is first reflected by the upper reflective surface 231 of the first reflective surface unit 23 toward the top reflecting surface 32 of the light shield 3 and then are reflected by the top reflecting surface 32 to project forwardly through the lens 6. In this way, a low beam pattern complying with regulations is formed.

Figure 5:
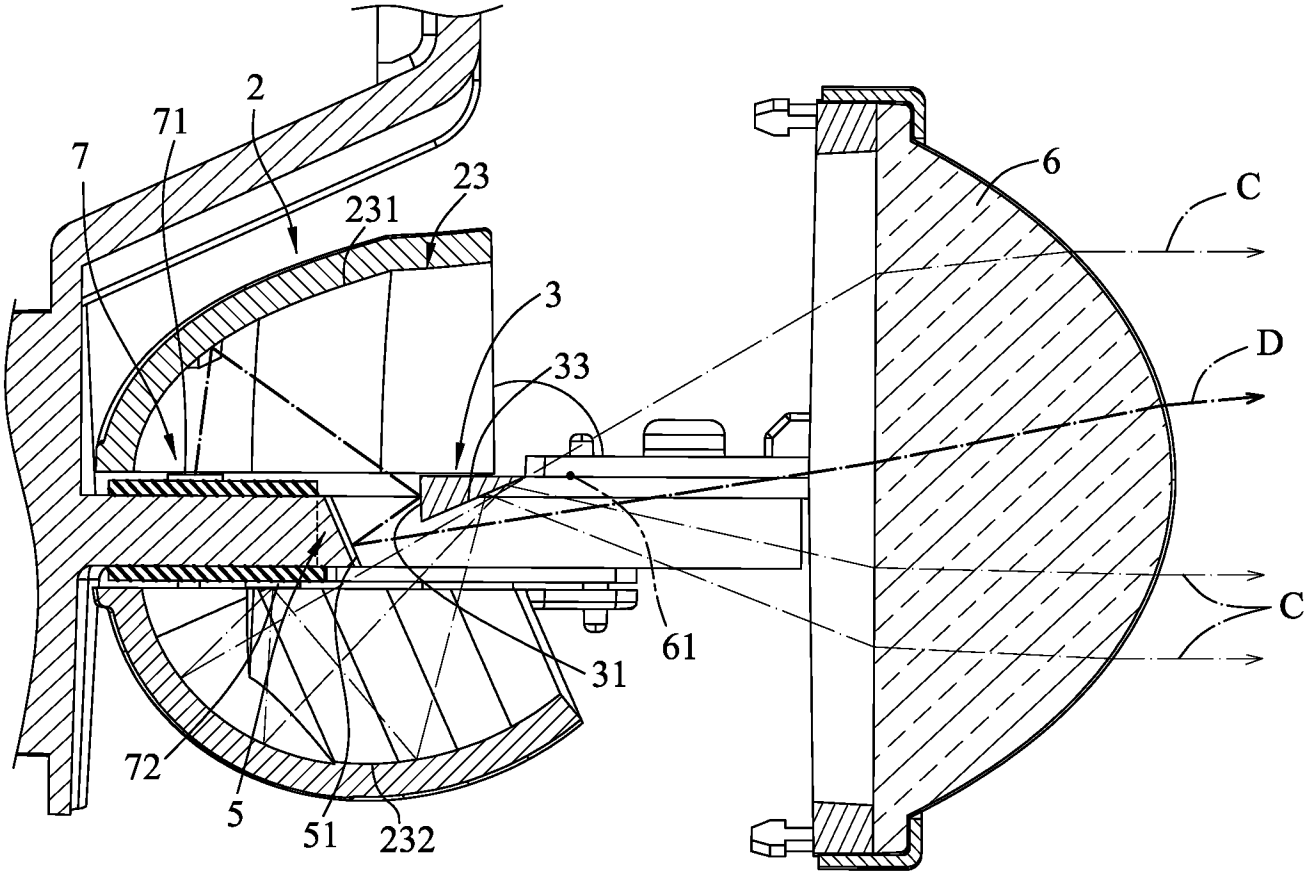
FIG. 5 is a fragmentary sectional view similar to FIG. 3, illustrating paths of light beams being emitted from a second light emitting element of the projection headlight and being reflected to form a high beam pattern for light compensation at a dark zone.

Referring to FIG. 5, the second light emitting element 72 emits a plurality of light beams and paths of the light beams are indicated by dash-dotted lines (C) and (D). The light beam indicated by an upmost one of the dash-dotted line (C) is reflected by the lower reflective surface 232 of the first reflective surface unit 23 to propagate forwardly and upwardly and is projected forwardly through the lens 6. The light beams indicated by the remaining two of the dash-dotted lines (C) are reflected by the lower reflective surface 232 of the first reflective surface unit 23 toward the bottom surface 33 of the light shield 3 and are then reflected by the bottom surface 33 to project forwardly through the lens 6. Note that a majority of the light beams indicated by the dash-dotted lines (C) are projected to a region above the cut-off line of the projection headlight, which is known as a dark zone.

As shown in FIGS. 4 and 5, when the first light emitting element 71 and the second light emitting element 72 both emit light, the light beams (A), (B) and (C) form a high beam light pattern complying with the regulations. In sum, when the high beam light pattern is required, both of the first and second light emitting elements 71, 72 are turned on to emit light whereas when a low beam light pattern is required (see FIG. 4), only the first light emitting element 71 is required to be turned on.

It should be noted that, in FIG. 5, the light beam indicated by a dash-dotted line (D) is emitted from the first light emitting element 71, is reflected by the upper reflective surface 231 of the first reflective surface unit 23 toward the second reflective surface unit 31 of the light shield 3, and then is reflected by the second reflective surface unit 31 toward the third reflective surface unit 51 to be projected forwardly and upwardly through the lens 6. The light beam (D) is also projected to a region above the cut-off line to further compensate for the luminance of the dark zone and thus the illumination of the projection headlight is improved and safety in using a vehicle mounted with the projection headlight can be improved.

By virtue of the first reflective surface unit 23, the second reflective surface unit 31 and the third reflective surface unit 51, light beams emitted from the first and second light emitting elements 71, 72 are properly reflected such that a luminance at the dark zone can be compensated. Note that the configuration of the first, second and third reflective surface units 23, 31, 51 can be modified by adjusting the structure, position and extending angle thereof to obtain a desired light pattern and a light exit angle in order to match the lamp housing 1 designed to have a certain aesthetic appearance.

As compared to the conventional headlight described in the background section that includes only two elements for reflecting light (the reflective mirror and the light shield), the projection head light of the present disclosure includes three elements, i.e. the first, second and third reflective surface units 23, 31, 51, for reflecting light, and thus an included angle between the light beam reflected by the third reflective surface unit 51 and an optical axis (not shown) of the projection headlight is smaller than an included angle between a light beam reflected by the light shield of conventional headlight and an optical axis thereof. In this way, the light beam emitted through the lens 6 would propagate through the housing wall 11 without being refracted by the bent portions 111, which will not result in insufficient illumination in the dark zone.

Further, it is relatively simple for controlling the optical stability of the projection headlamp of the present disclosure when modifying the design thereof. As a result, a relatively good light compensating effect and integrity and quality of light pattern projected by the projection headlamp can be obtained. In this way, the application range of the projection headlamp of the present disclosure is relatively flexible and the paths of light beams of the projection headlamp can be easily adjusted according the design of the lamp housing 1. Even if the lamp housing 1 is designed to have many curved structures, the configuration of the first, second and third reflective surface units 23, 31, 51 can be modified accordingly to obtain a desired light pattern.

Additionally, the projection headlight of the present disclosure is capable of providing light patterns of, but not limited to, a low beam and a high beam and can be used for light compensation as required.

It should be noted that, the lens 6 has a focal point 61 located behind the lens 6 and the light shield 3 is disposed behind the focal point 61 of the lens 6 such that an image of the light shield 3 would not be formed in front of the projection headlight, i.e., the light shield 3 is not visible in front of the projection headlight, and thus provides a relatively good aesthetic appearance.

Referring to FIG. 6, a modification of the light shield 3 is shown. The second reflective surface 31 of the modified light shield 3 is formed with a plurality of light distributing surface portions 311 arranged side-by-side in the transverse direction (T) and configured to distribute light emitted from the light emitting unit 7. Each of the light distributing surface portions 311 is a rearward-facing curved surface that is forwardly concave. By virtue of the light distributing surface portions 311, light shape of the projection headlight can be adjusted and distributed evenly to increase range of illumination in the transverse direction (T).

Figure 7:
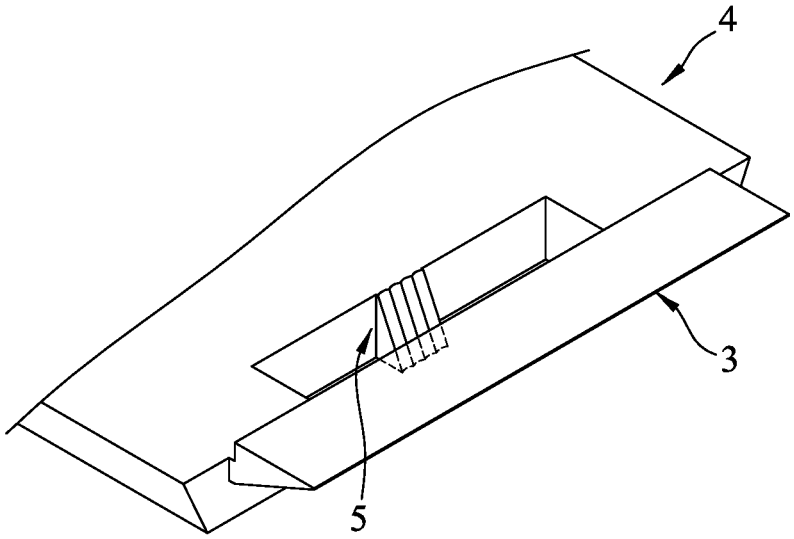
FIG. 7 is a fragmentary perspective view of a reflector and a light shield of the projection headlight according to a second embodiment of the present disclosure.

Referring to FIG. 7, the projection headlight of a second embodiment of the present disclosure similar to the first embodiment is shown, and the difference therebetween resides in that the heat dissipating unit 4 of the second embodiment is connected integrally to the reflector 5 and the light shield 3.

Figure 8:
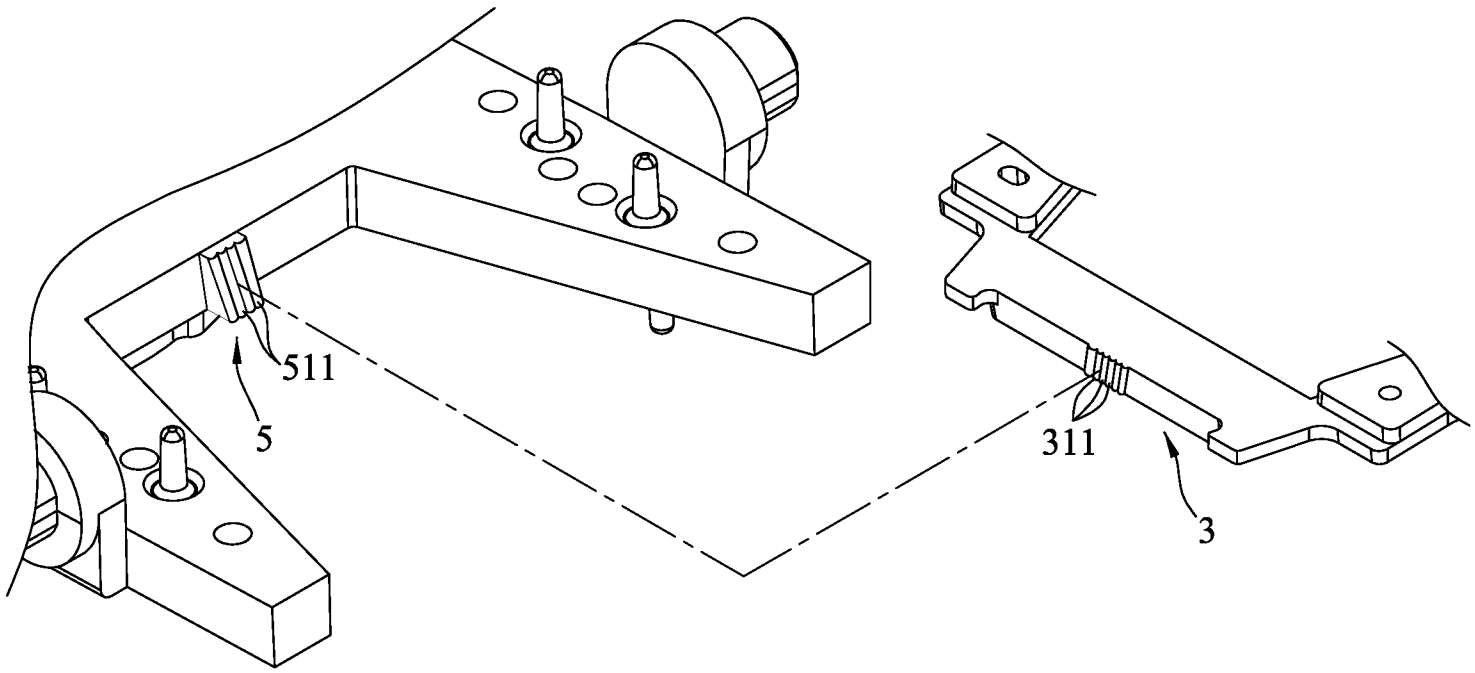
FIG. 8 is a fragmentary perspective view of a reflecting element and a light shield of the projection headlight according to a third embodiment of the present disclosure.

Referring to FIG. 8, the projection headlight of a third embodiment of the present disclosure is similar to the first embodiment. The difference between the first and third embodiments resides in the structure of the light shield 3 and the reflector 5. In the third embodiment, each of the light distributing structures 511 of the reflector 5 is a forward-facing curved surface that is forwardly convex and each of the light distributing surface portions 311 of the light shield 3 is a rearward-facing curved surface that is rearwardly convex. By virtue of the light distributing surface portions 311 and the light distributing structures 511, light emitted from the light emitting unit 7 can be distributed evenly in the transverse direction (T). In this way, the range of illumination of the projection headlamp of the present disclosure in the transverse direction (T) can be increased. Further, the design of the light distributing structures 511 being forwardly convex and the light distributing surface portions 311 being rearwardly convex facilitates simplifying the molds for making the light distributing structures 511 and the light distributing surface portions 311. In this way, manufacturing cost for molds of the reflector 5 and the light shield 3 can be reduced and the overall manufacturing cost for the projection headlight can thus be reduced.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A projection headlight, comprising:

a reflecting mirror having a mounting space that is defined by a first reflective surface unit;

a light shield disposed in said mounting space and including a second reflective surface unit facing rearwardly;

a reflector disposed in said mounting space, disposed behind said light shield and including a third reflective surface unit facing toward said second reflective surface unit;

a lens disposed in front of said reflecting mirror and said light shield; and a light emitting unit disposed in said mounting space, disposed behind said light shield, and emitting a light beam that is reflected by said first reflective surface unit toward said second reflective surface unit, and that is then reflected by said second reflective surface unit toward said third reflective surface unit to be projected forwardly through said lens;

wherein said reflecting mirror includes an upper reflecting portion, and a lower reflecting portion disposed below and cooperating with said upper reflecting portion to define said mounting space, said first reflective surface unit including an upper reflective surface formed on said upper reflecting portion and a lower reflective surface formed on said lower reflecting portion, said light emitting unit including a first light emitting element that faces said upper reflecting portion and that emits a light beam reflected by said upper reflective surface toward said second reflective surface unit, and a second light emitting element that faces said lower reflecting portion and that emits a light beam reflected by said lower reflective surface toward said light shield and then reflected by said light shield to be projected toward said lens.

2. The projection headlight as claimed in claim 1 further comprising a heat dissipating unit including a base board extending into said mounting space and connected thermally to said reflector and a plurality of heat dissipating fins integrally connected to said base board.

3. The projection headlight as claimed in claim 2, wherein said third reflective surface unit of said reflector is formed on said base board by vacuum coating.

4. The projection headlight as claimed in claim 1, wherein said second reflective surface unit of said light shield is formed with a plurality of light distributing surface portions arranged side-by-side in a transverse direction transverse to a front-rear direction in which said lens is spaced apart from said reflecting mirror, and configured to distribute light emitted from said light emitting unit in the transverse direction.

5. The projection headlight as claimed in claim 4, wherein said third reflective surface unit of said reflector is formed with a plurality of light distributing structures arranged side-by-side in the transverse direction and configured to distribute light emitted from said light emitting unit in the transverse direction, each of said light distributing structures being one of a forward-facing curved surface that is rearwardly concave and a forward-facing curved surface that is forwardly convex, each of said light distributing surface portions being one of a rearward-facing curved surface that is rearwardly convex and a rearward-facing curved surface that is forwardly concave.

6. The projection headlight as claimed in claim 1, wherein said third reflective surface unit of said reflector is formed with a plurality of distributing structures arranged side-by-side in a transverse direction transverse to a front-rear direction in which said lens is spaced apart from said reflecting mirror and configured to distribute light emitted from said light emitting unit in the transverse direction.

7. The projection headlight as claimed in claim 1, wherein said lens is a convex lens, said lens having a focal point located behind said lens, said light shield being disposed behind the focal point of said lens.

* * * * *